US006667670B2

(12) United States Patent
Hong et al.

(10) Patent No.: US 6,667,670 B2
(45) Date of Patent: Dec. 23, 2003

(54) MICROWAVE DOUBLE-POLE DOUBLE-THROW SWITCH AND MICROWAVE DIVIDE/THROUGH SWITCH AND POWER AMPLIFIER USING THEREOF

(75) Inventors: Soung-Chol Hong, Taejon (KR); Doo-Young Ha, Taejon (KR)

(73) Assignee: Korea Institute of Science and Technology, Taejon (KR)

( * ) Notice: Subject to any disclaimer, the term of this patent is extended or adjusted under 35 U.S.C. 154(b) by 0 days.

(21) Appl. No.: 09/756,757

(22) Filed: Jan. 10, 2001

(65) Prior Publication Data

US 2002/0030552 A1 Mar. 14, 2002

(30) Foreign Application Priority Data

Jul. 25, 2000 (KR) ..... 20000-42613

(51) Int. Cl.[7] ..... H01P 1/10; H01P 5/16

(52) U.S. Cl. ..... 333/101; 333/103; 333/117; 330/124 R; 330/51

(58) Field of Search ..... 333/101, 103, 333/117, 116, 104; 330/124 R, 51

(56) References Cited

U.S. PATENT DOCUMENTS 3,659,227 A * 4/1972 Whistler ..... 333/103
3,911,372 A * 10/1975 Seidel ..... 330/53
4,697,160 A * 9/1987 Clark ..... 333/103
5,101,171 A * 3/1992 Redmond ..... 330/124 R

OTHER PUBLICATIONS

Robertson et al. "Solid state power amplifier using impedance–transforming branch–line couplers for L–band satellite systems", Jun. 9, 1993, XP 000629961 pp. 448–450.*

* cited by examiner

*Primary Examiner*—Robert Pascal
*Assistant Examiner*—Joseph Chang
(74) *Attorney, Agent, or Firm*—Bacon & Thomas, PLLC

(57) ABSTRACT

A highly efficient power amplifier is composed of (1) two microwave divide/through switches, (2) two power amplifiers, connected with the two microwave divide/through switches, to amplify the signal power transmitted from the first microwave divide/through switch, and (3) a half-wavelength transformer, connected to an output terminal of one of the power amplifiers, to delay the phase of the amplified signal by a half-wavelength.

2 Claims, 15 Drawing Sheets

(a) On-state.

(b) Off-state.

(a)

(b)

| 2GHz | 10GHz |
|---|---|
| $Z_0$ : 50 Ω | $Z_0$ : 50 Ω |
| $w_1$ : 284 μm | $w_1$ : 284 μm |
| $w_2$ : 542 μm | $w_2$ : 542 μm |
| $L_1$ : 14.10 mm | $L_1$ : 3.025 mm |

(a)

(b)

MICROWAVE DOUBLE-POLE DOUBLE-THROW SWITCH AND MICROWAVE DIVIDE/THROUGH SWITCH AND POWER AMPLIFIER USING THEREOF

BACKGROUND OF THE INVENTION

1. Field of the Invention

The present invention relates generally to a microwave switch, and more particularly it relates to a microwave DPDT (Double-Pole Double-Throw) switch, a microwave divide/through switch, and a highly efficient power amplifier using the divide/through switch.

2. Description of the Related Art

Microwave and millimeter-wave switches are widely used components in wireless circuit such as phase shifters, phase-array antenna, transceivers, QPSK (Quadrature Phase Shift Keying) and PSK (Phase Shift Keying) system. Most of known microwave switches are FETs (field effect transistors) and PIN diodes, since they can be made in the same process as MMIC (Microwave Monolithic Integrated Circuit). But these kinds of microwave switches have high insertion losses, poor isolation, inevitable nonlinearity, and standing power property.

To resolve the above shortcomings, Larson et. al. reported a microwave switch in the early 1990's, which needed high initial voltages larger than about 100 V to operate, composed of micro-motors. J. Yao et. al. showed a switch of cantilever type which had a 50 dB isolation and a 0.1 dB insertion loss at 4 GHz. Its switching voltage and closure time are 28 V and 30 $\mu$s, respectively. This switch is of series and resistance type. Goldsmith et. al. presented a switch of shunt and capacitor type, and Pacheco et. al. did an anti-vibration switch.

Most of micro-machined microwave switches are much slower than PIN diodes and FET (field effect transistor) switches and need higher switching voltages. And the handling powers are also smaller than their semiconductor counterparts. But microwave switches show low insertion losses ($\leqq$0.5 dB) at the on-state, and high isolation ($\geqq$40 dB) at the off-state. When they are not activated, there is no power consumption. In addition, they have no nonlinearity at all. Due to these advantages, they are used beneficially in the RF communication systems.

And since double-pole double-throw (DPDT) switches used frequently in microwave systems have complicated structures needing four SPST (Single-Pole Single-Throw) switches as displayed in FIG. 1, it is necessary to simplify the structures.

Meanwhile, general balance power amplifiers are composed of two amplifiers and two branch line couplers as displayed in FIG. 2 in order to give balance property of the power amplifiers. These balance power amplifiers have a disadvantage of low efficiencies when the average powers of input signals are much lower than maximum available powers of the amplifiers.

SUMMARY OF THE INVENTION

It is an object of the present invention to provide (1) a microwave DPDT switch routing two input signals into two output signals with simple structure, (2) a microwave divide/through switch dividing the input signal into two output signals or transmitting an input signal into a single output signal, and (3) a highly efficient power amplifier of balance property using the divide/through switch instead of branch line coupler.

The microwave DPDT switch according to the present invention is composed of (1) a branch line coupler having three gaps at the branch lines among two input and two output ports, and (2) three SPST switches locating at the three branch line gaps to transmit input signals to the output ports.

The microwave divide/through switch according to the present invention, dividing or transmitting input signals to the output ports, is composed of (1) a 90° branch line coupler having two gaps at the branch lines among two input and output ports, and (2) two SPST switches locating at the two branch line gaps to transmit input signals to the output ports.

The highly efficient power amplifier according to the present invention is composed of (1) the two microwave divide/through switches, (2) two power amplifiers, connected with the two microwave divide/through switches, to amplify the signal power transmitted from the first microwave divide/through switch, and (3) a half-wavelength transformer, connected to an output of one of the power amplifiers, to delay the phase of the amplified signal by a half-wavelength.

BRIEF DESCRIPTION OF THE DRAWINGS

Exemplary embodiments of the present invention will be described in conjunction with the drawings in which.

DETAILED DESCRIPTION OF THE EMBODIMENTS

The details such as the number of microwave switches and the activation frequencies are presented below to give the overall understandings of this invention. The person who has general knowledge in this field knows evidently that this invention can be realized without saying these specific details. We will omit common knowledge and detailed explanations on the composition which can blur the major points of this invention.

Figure 1:
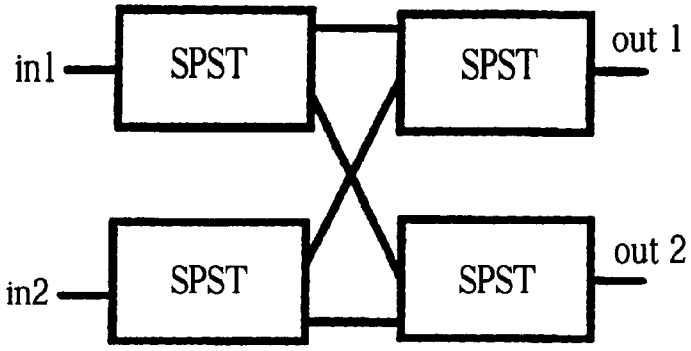
FIG. 1 Prior Art
FIG. 1 shows a schematic diagram for a conventional DPDT switch.
Figure 2:
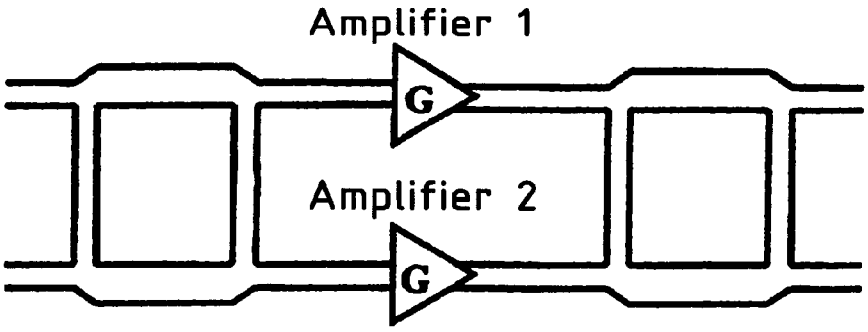
FIG. 2 Prior Art
FIG. 2 shows a schematic diagram for a conventional, highly efficient power amplifier.
Figure 3:
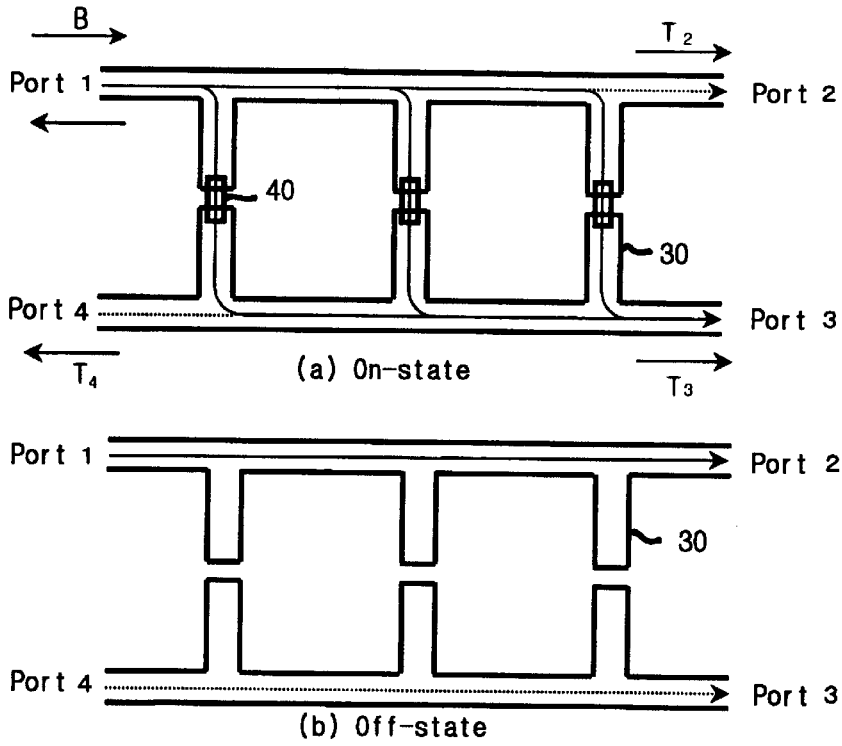
FIG. 3 shows a schematic diagram for a microwave DPDT switch according to an embodiment of the present invention.

First of all, the microwave DPDT switch according to an embodiment of the present invention is composed of three SPST switches (40) and branch line coupler (30) with three gaps as shown in FIG. 3. The three SPST switches (40) are micro-machined microwave ones, and the detail explanations for these switches can be found in an Korean Patent Application with the title of "push-pull type micro-machined microwave switch" applied at May 25, 2000 by the present assignee. (Korean Patent No. 10-2000-28034) This microwave DPDT switch can consist of Ga—As FETs or PIN diodes.

In the meantime, the above-mentioned microwave DPDT switch has two states. If the three SPST switches (40) are "on" (cross state) as in FIG. 3(*a*), the signal at the port 1 is transmitted to the port 3, and the signal at the port 4 to the port 2. If the three SPST switches (40) are "off" (bar state) as in FIG. 3(*b*), the signal at the port 1 is transmitted to the port 2, and the signal at the port 4 to the port 3. Let the port 1 be input 1, the port 4 be input 2, the port 2 be output 1, and the port 3 be output 2. Then, the microwave DPDT switch can transmit the inputs 1 and 2 to the outputs 1 and 2 according to the on/off states of the three SPST switches (40).

The odd/even mode transmission matrix of the above mentioned microwave DPDT switch can be expressed in Eq. (1), $$\begin{bmatrix} A & B \\ C & D \end{bmatrix}_e = \begin{bmatrix} 1 & 0 \\ j & 1 \end{bmatrix}\begin{bmatrix} 0 & j \\ j & 0 \end{bmatrix}\begin{bmatrix} 1 & 0 \\ j & 1 \end{bmatrix}\begin{bmatrix} 0 & j \\ j & 0 \end{bmatrix}\begin{bmatrix} 1 & 0 \\ j & 1 \end{bmatrix} = \begin{bmatrix} 0 & -j \\ -j & 0 \end{bmatrix} \quad \text{[EQUATION 1]}$$

$$\begin{bmatrix} A & B \\ C & D \end{bmatrix}_0 = \begin{bmatrix} 1 & 0 \\ -j & 1 \end{bmatrix}\begin{bmatrix} 0 & j \\ j & 0 \end{bmatrix}\begin{bmatrix} 1 & 0 \\ -j & 1 \end{bmatrix}\begin{bmatrix} 0 & j \\ j & 0 \end{bmatrix}\begin{bmatrix} 1 & 0 \\ -j & 1 \end{bmatrix} = \begin{bmatrix} 0 & j \\ j & 0 \end{bmatrix}$$

where the transmission and reflection coefficients of the odd/even modes are in Eq. (2), $$\Gamma_e = \left[\frac{A+B-C-D}{A+B+C+D}\right]_e = \frac{-j+j}{-2j} = 0, \quad \text{[EQUATION 2]}$$

$$T_e = \left[\frac{2}{A+B+C+D}\right]_e = \frac{2}{-2j} = j$$

$$\Gamma_0 = \left[\frac{A+B-C-D}{A+B+C+D}\right]_e = \frac{j-j}{2j} = 0,$$

$$T_0 = \left[\frac{2}{A+B+C+D}\right]_e = \frac{2}{2j} = -j$$

In this case, if all the microwave DPDT switched are "on" state and B_1 is 1, then $\Gamma_1$, $T_2$, $T_3$, and $T_4$ are 0, 0, j and 0, respectively, by Eq. (3) below.

$$\Gamma_1 = \frac{1}{2}\Gamma_e + \frac{1}{2}\Gamma_0 = 0,\ T_2 = \frac{1}{2}T_e + \frac{1}{2}T_0 = 0 \quad \text{[EQUATION 3]}$$

$$T_3 = \frac{1}{2}T_e - \frac{1}{2}T_0 = j,\ T_4 = \frac{1}{2}\Gamma_e - \frac{1}{2}\Gamma_0 = 0$$

If all the microwave DPDT switches are in the "off" state, B_1 is 1, and the even modes are excited, then $\Gamma_1=\Gamma_e=0$, $T_2=T_e=j$, and $T_3=T_4=0$. The above microwave DPDT switch can be designed as 2 GHz and 10 GHz switches.

Figure 4:
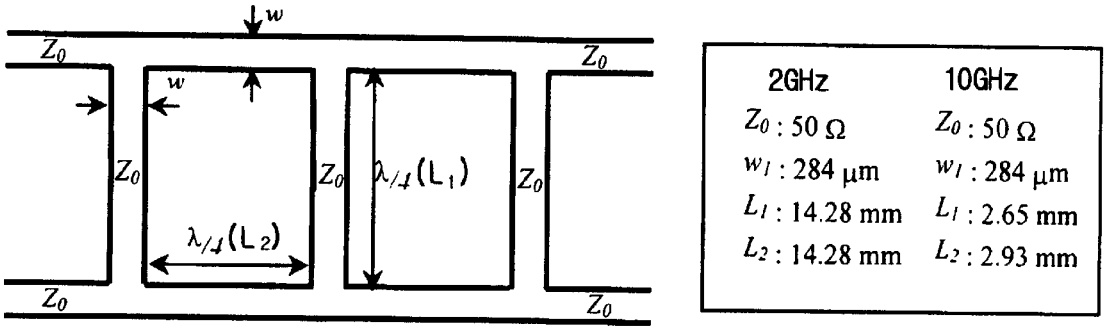
FIG. 4 shows a schematic diagram for a branch line coupler of the microwave DPDT switch according to an embodiment of the present invention.
Figure 5:
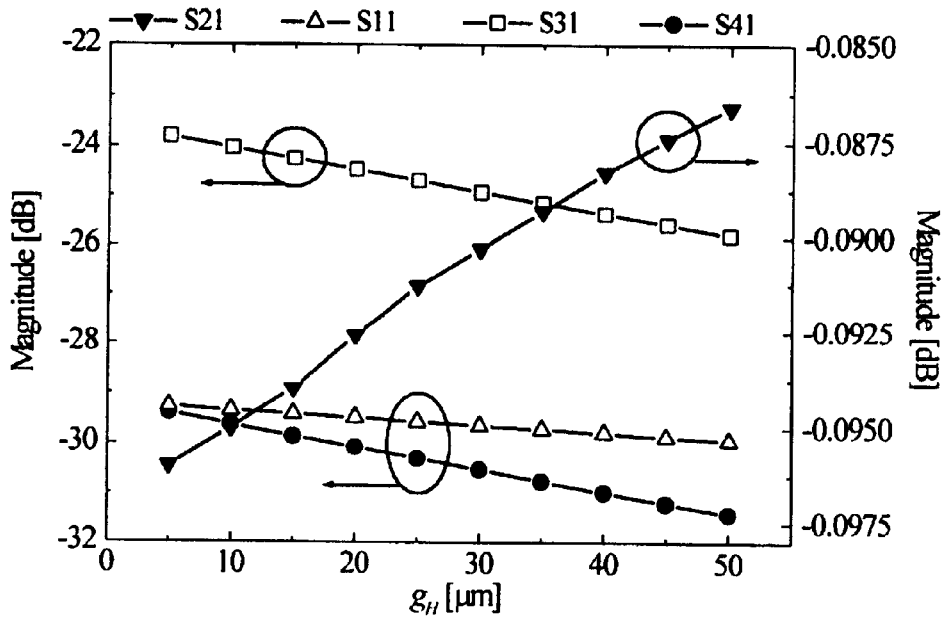
FIG. 5 shows the calculated values of S-parameters versus $g_H$ at 2 GHz when the microwave DPDT switch in FIG. 4 is in the off-state.
Figure 6:
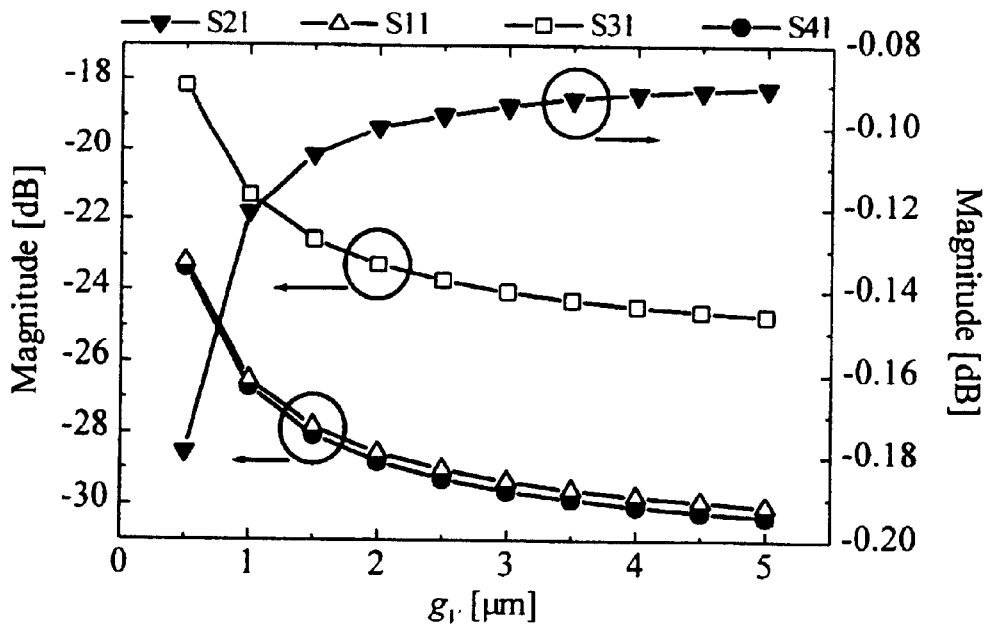
FIG. 6 shows the calculated values of S-parameters versus $g_V$ at 2 GHz when the microwave DPDT switch in FIG. 4 is in the off-state.
Figure 7:
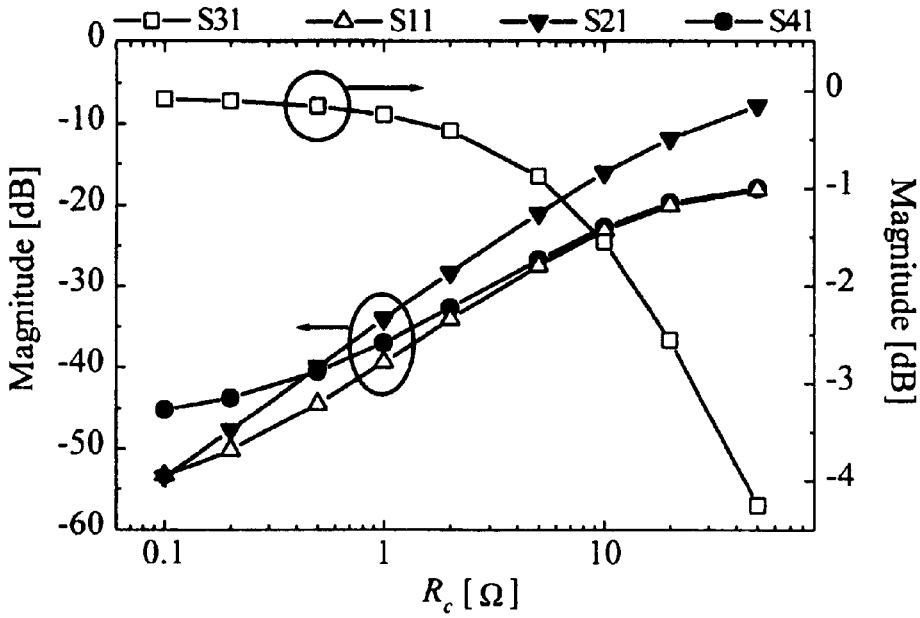
FIG. 7 shows the calculated values of S-parameters versus $R_c$ at 2 GHz when the microwave DPDT switch in FIG. 4 is in the on-state.

FIG. 4 shows a schematic diagram for a branch line coupler of the microwave DPDT switch according to an embodiment of the present invention. The calculated values of S-parameters versus $g_H$ are shown in FIG. 5, where the microwave DPDT switch is in the off-state at 2 GHz. The values of S-parameters versus $g_V$ in the off-state are shown in FIG. 6. In FIG. 6, $S_{21}$ hardly changes for $g_V \geqq 1.5[\mu m]$. And the graph of S-parameters versus $R_c$ in the on-state is presented in FIG. 7. If the insertion loss is 0.5 DB, $R_c$ can be 1[Ω].

Figure 8:
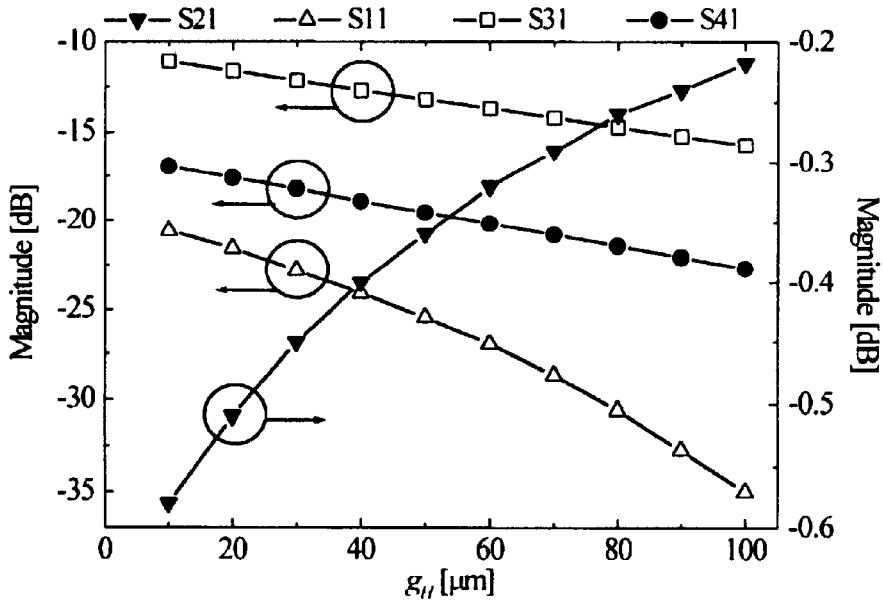
FIG. 8 shows the calculated values of S-parameters versus $g_H$ at 10 GHz when the microwave DPDT switch in FIG. 4 is in the off-state.
Figure 9:
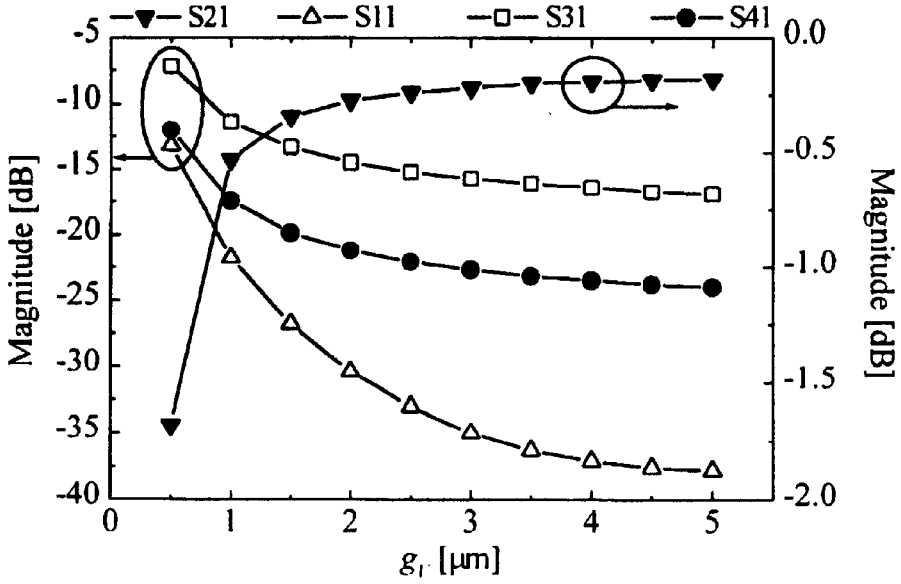
FIG. 9 shows the calculated values of S-parameters versus $g_V$ at 10 GHz when the microwave DPDT switch in FIG. 4 is in the off-state.
Figure 10:
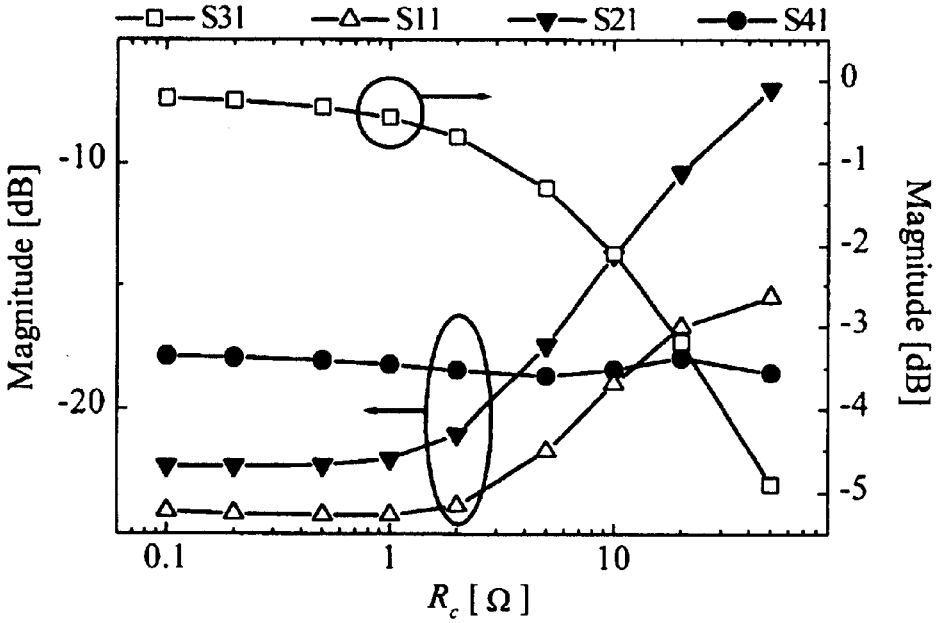
FIG. 10 shows the calculated values of S-parameters versus $R_c$ at 10 GHz when the microwave DPDT switch in FIG. 4 is in the on-state.

The calculated values of S-parameters versus $g_H$ are shown in FIG. 8, where the microwave DPDT switch is in the off-state at 10 GHz. Unlike at 2 GHz, the S-parameters change considerably according to the change of $g_H$. And the values of S-parameters versus $g_V$ in the off-state are shown in FIG. 9. In FIG. 9, $S_{21}$ hardly changes for $g_V \geqq 1.5[\mu m]$. And the graph of S-parameters versus $R_c$ in the on-state is presented in FIG. 10. If the insertion loss is 0.5 dB, $R_c$ can be 1[Ω].

Figure 11:
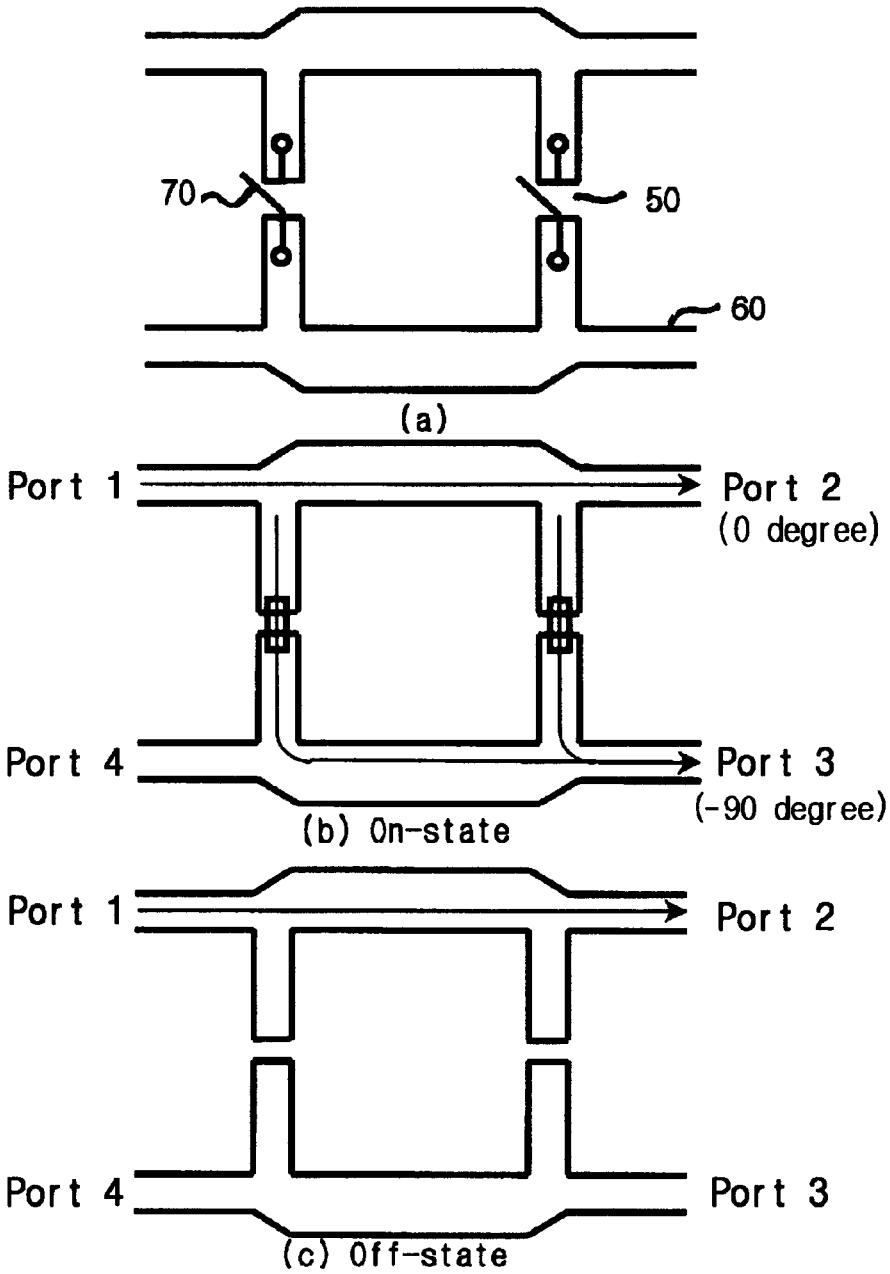
FIG. 11 shows a schematic diagram for a microwave divide/through switch according to an embodiment of the present invention.

In the below, we explain the structure and action of a microwave divide/through switch according to an embodiment of the present invention. FIG. 11 shows the outline of the microwave divide/through switch as an example of this invention. As shown in FIG. 11(*a*), the microwave divide/ through switch consists of a 90° branch line coupler (60) with two gaps (50) at the center and two SPST switches (70). If the two SPST switches (70) are "on" as in FIG. 11(*b*), the signal at the port 1 is transmitted to the ports 2 and 3 with its power divided equally, where the phase difference of the signals at the ports 2 and 3 is 90°. In the meantime, if the two SPST switches (70) are in the "off" states as in FIG. 11(*c*), the signal at the port 1 is transmitted only to the port 2. The branch line coupler (60) having the switches in this way is modeled with a micro-strip gap (MGAP), capacitors and resisters as shown is FIG. 12. This microwave divide/through switch can be designed at 2 GHz or 10 GHz.

Figure 12:
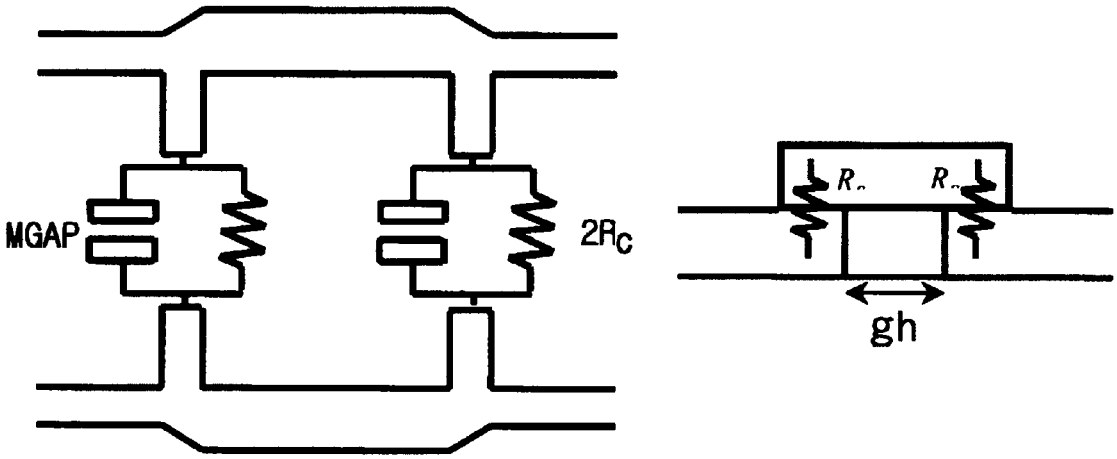
FIG. 12 shows a modeling for the microwave divide/through switch in FIG. 11.
Figure 12:
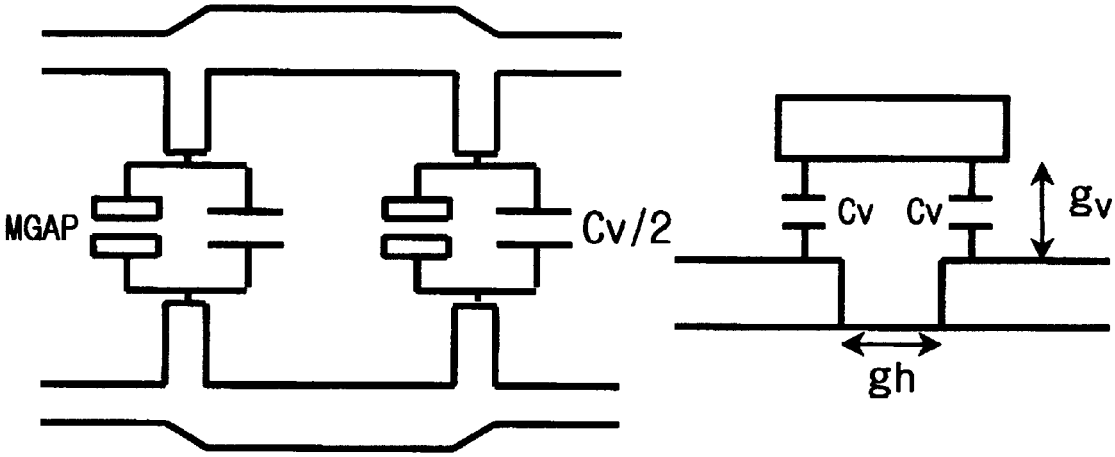
Figure 13:
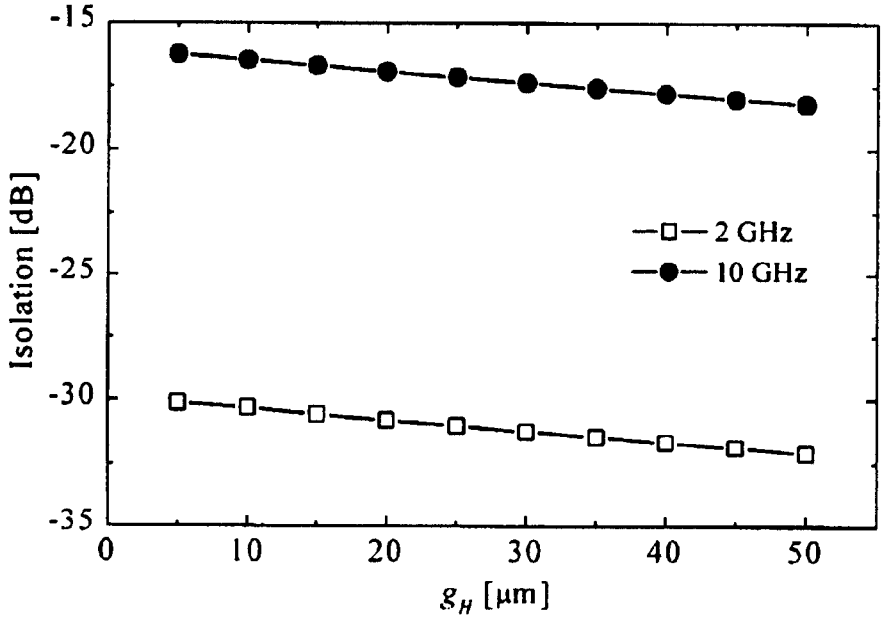
FIG. 13 shows the calculated isolation versus separation of microstrip line gap ($g_H$) and the distance between the movable contact electrode and the microstrip line ($g_V$) of the microwave divide/through switch in FIG. 12.
Figure 13:
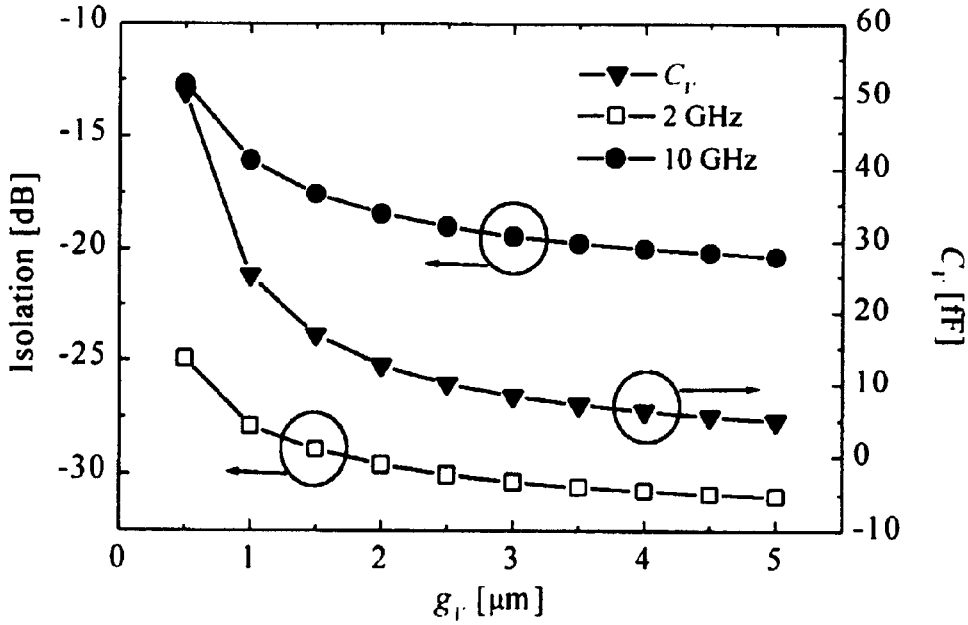
Figure 14:
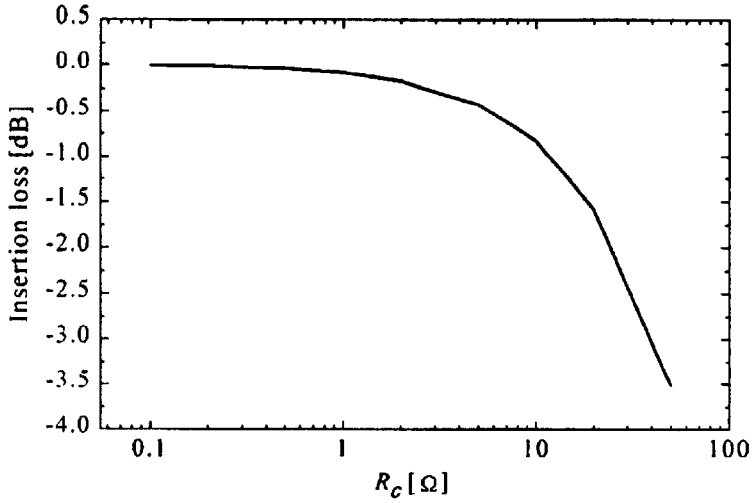
FIG. 14 shows the calculated insertion loss versus contact resistance ($R_c$) of the microwave divide/through switch in FIG. 12.

FIG. 13 shows the calculated isolation versus separation of microstrip line gap ($g_H$) and the distance between the movable contact electrode and the microstrip line ($g_V$) of the microwave divide/through switch in FIG. 12. The isolation decreases when $g_V$ and $g_H$ increase. And the calculated insertion losses versus contact resistance ($R_c$) are shown in FIG. 14. The insertion loss decreases when $R_c$ increases.

Figure 15:
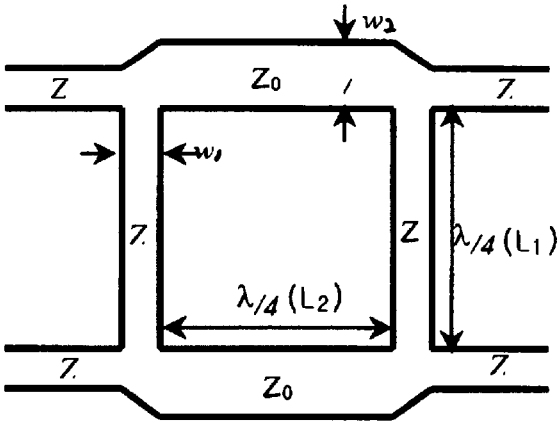
FIG. 15 shows a schematic diagram for a branch line coupler of the microwave divide/through switch according to an embodiment of the present invention.
Figure 16:
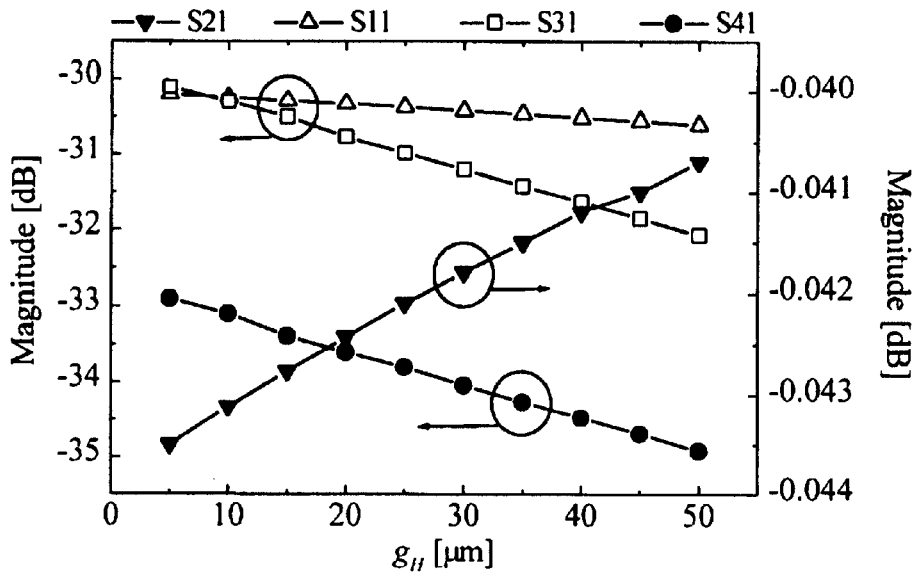
FIG. 16 shows the calculated values of S-parameters versus $g_H$ at 2 GHz when the divide/through switch is in the off-state.
Figure 17:
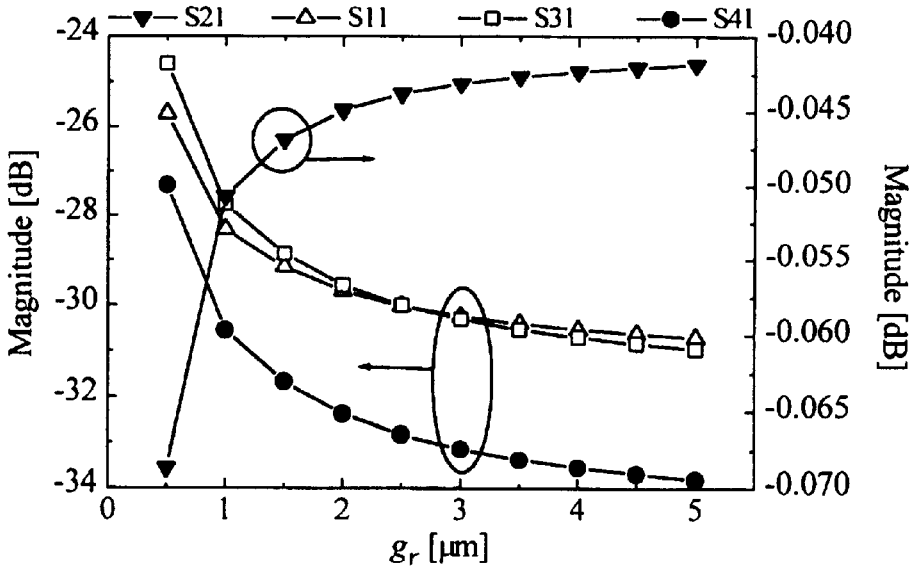
FIG. 17 shows the calculated values of S-parameters versus $g_V$ at 2 GHz when the divide/through switch is in the off-state.
Figure 18:
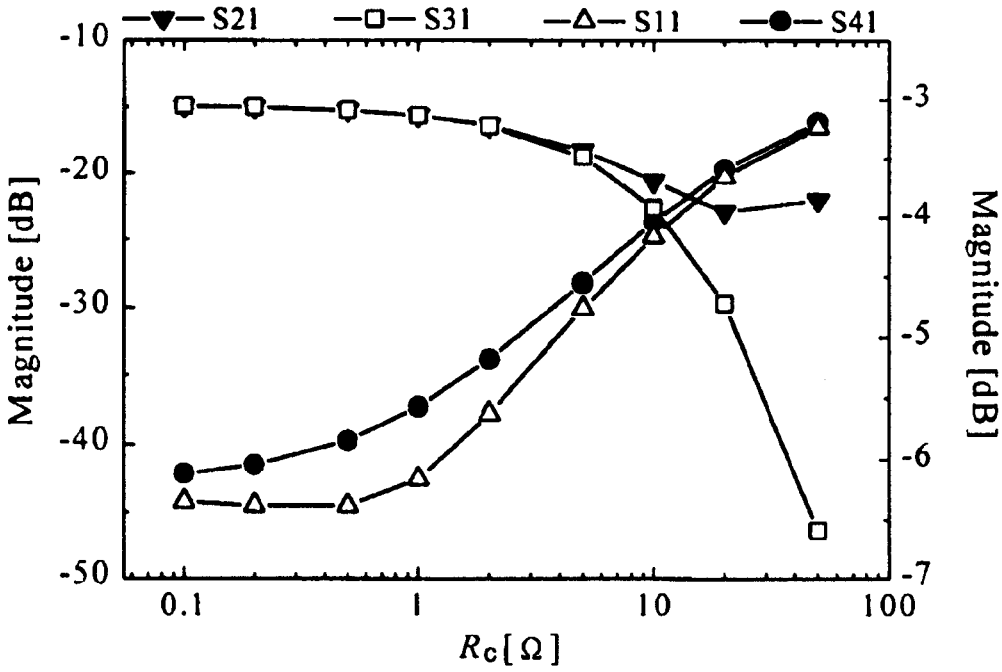
FIG. 18 shows the calculated values of S-parameters versus $R_c$ at 2 GHz when the divide/through switch is in the on-state.

FIG. 15 shows a schematic diagram for a branch line coupler of the microwave divide/through switch according to an embodiment of the present invention. It has branches of different lengths and widths according to 2 GHz and 10 GHz switches. The lengths and widths are shown in FIG. 15 for 2 GHz and 10 GHz switches, respectively. In FIG. 15, the lengths of branches are $\lambda/4$. The calculated S-parameters of divide/through switch in the off-state at 2 GHz are shown in FIG. 16 according to $g_H$. The S-parameters change in accordance with $g_H$. The calculated S-parameters of divide/through switch in the off-state at 2 GHz are shown is FIG. 17 according to $g_V$. From FIG. 17, $S_{21}$ hardly changes for $g_V \geqq 1.5[\mu m]$. The calculated S-parameters of divide/through switch in the on-state at 2 GHz is shown in FIG. 18 according to $R_c$. If the insertion loss of 0.5 dB is permitted, the contact resistance ($R_c$) of 2[Ω] is accepted. The output powers at the ports 2 and 3 in FIG. 11 are considerably different for contact resistance $(R_c) \geqq 10[\Omega]$.

Figure 19:
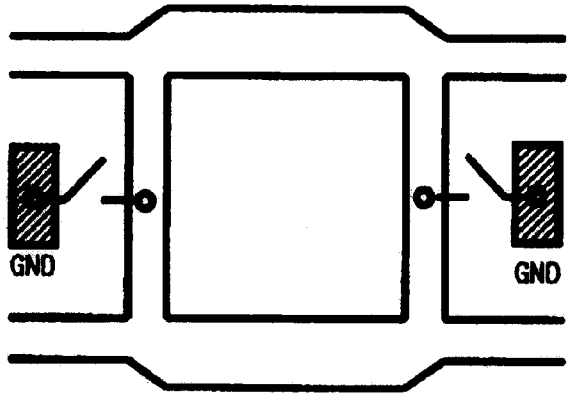
FIG. 19 shows a schematic diagram for a shunt-type, microwave divide/through switch according to another embodiment of the present invention.
Figure 19:
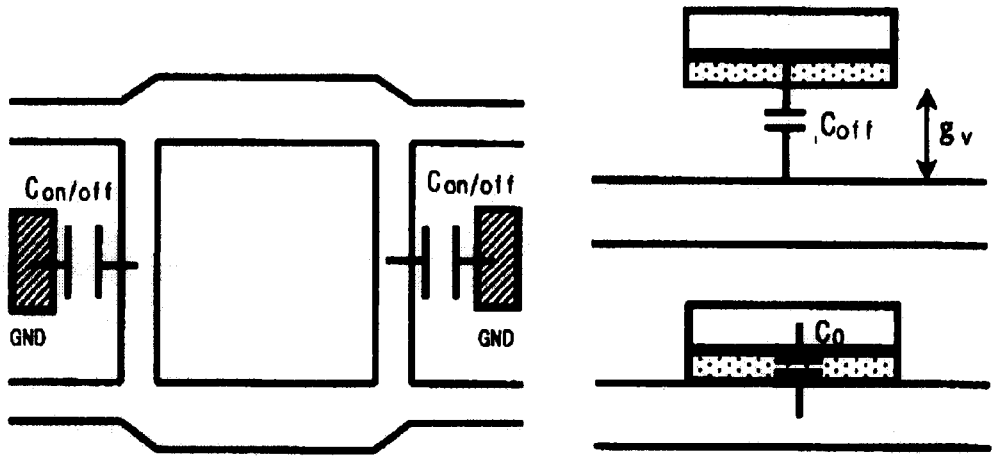
Figure 20:
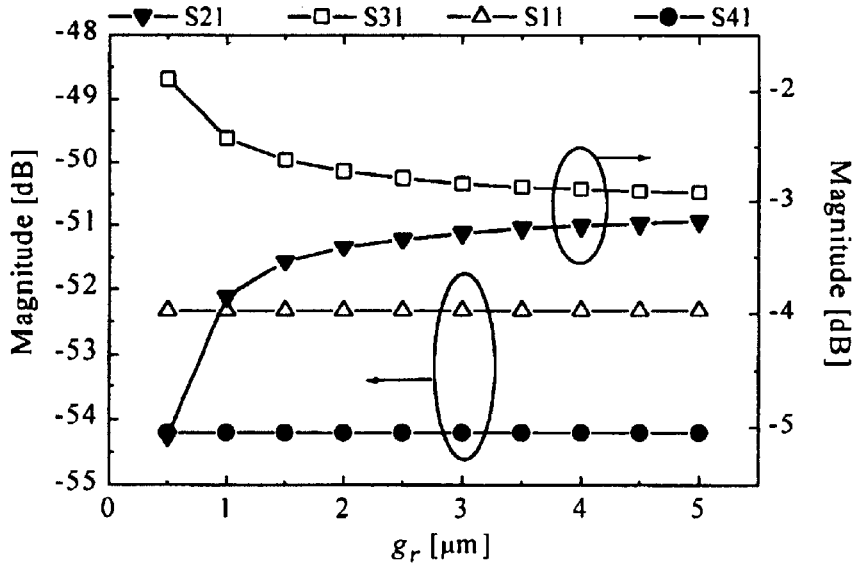
FIG. 20 shows the calculated values of S-parameters versus $g_V$ at 2 GHz when the shunt-type, divide/through DPDT switch is in the off-state.

The above switch is of a series type. FIG. 19 shows a schematic diagram for a shunt-type, microwave divide/through switch according to another embodiment of the present invention. And FIG. 20 shows the calculated values of S-parameters versus $g_V$ when the shunt-type, divide/through DPDT switch is in the off-state at 2 GHz.

Figure 21:
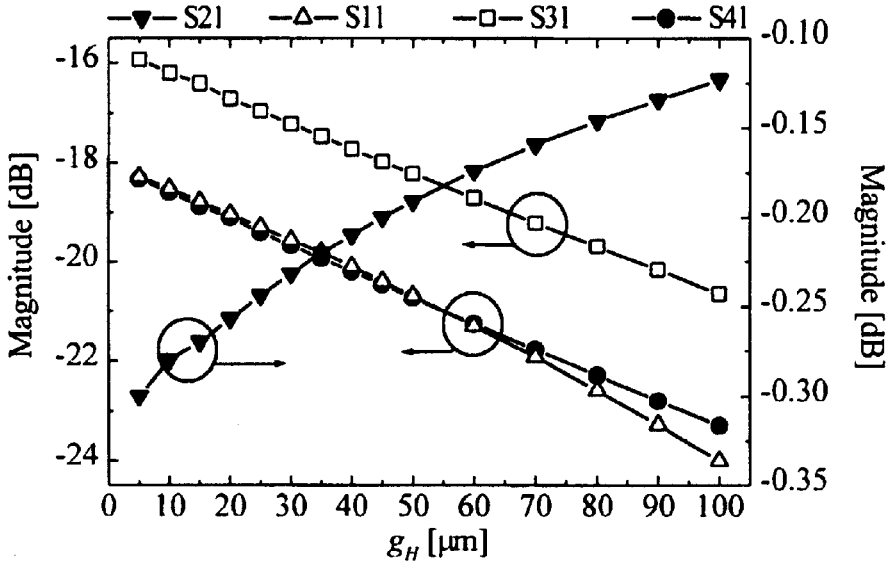
FIG. 21 shows the calculated values of S-parameters versus $g_H$ at 10 GHz when the divide/through switch is in the off-state.
Figure 22:
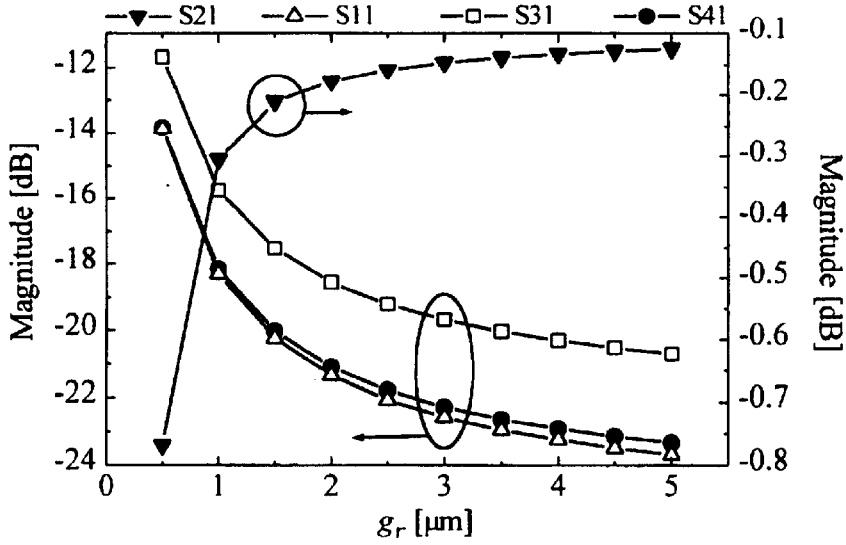
FIG. 22 shows the calculated values of S-parameters versus $g_V$ at 10 GHz when the divide/through switch is in the off-state.

We will explain a divide/through switch at 10 GHz below. The calculated isolation versus $g_H$ and $g_V$ are displayed in FIG. 13. The calculated insertion losses versus contact resistance ($R_c$) are the same as those of the switch at 2 GHz as shown in FIG. 14. FIG. 21 shows the calculated values of S-parameters versus $g_H$ when the divide/through switch is in the off-state at 10 GHz. From FIG. 21, $S_{21}$ is larger than −0.2 dB for $g_H \geqq 50[\mu m]$. The calculated S-parameters of the divide/through switch in the off-state are shown in FIG. 22 according to $g_V$. $S_{21}$ hardly changes for $g_V \geqq 1.5[\mu m]$ from FIG. 22.

Figure 23:
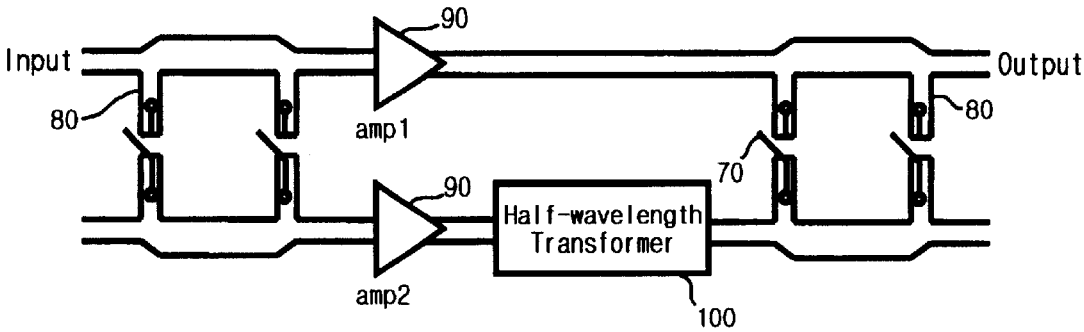
FIG. 23 shows a schematic diagram for a highly efficient power amplifier according to an embodiment of the present invention.

Below, we will explain the structure of a high efficient power amplifier utilizing the above mentioned microwave divide/through switch. FIG. 23 shows a schematic diagram for a high efficient power amplifier according to an embodiment of the present invention. As shown in FIG. 23, the high efficient power amplifier consists of two microwave divide/through switches (80), the two power amplifier (90) between the microwave divide/through switches, and a half wavelength transformer (100) connected to the output terminal of the one of the power amplifiers (90).

Figure 24:
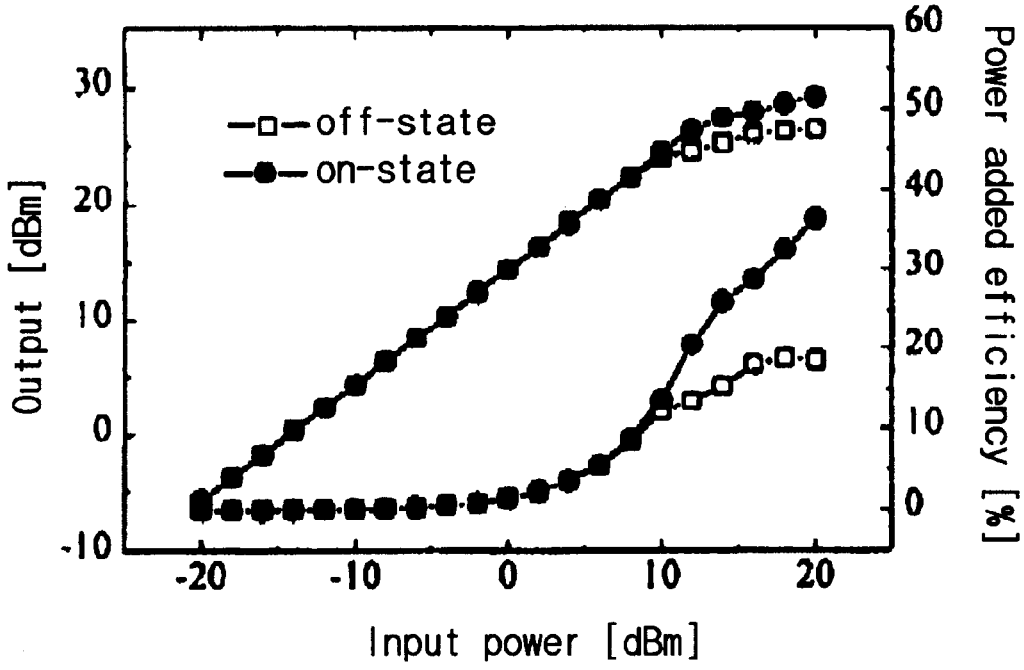
FIG. 24 shows the output power and PAE of the highly efficient power amplifier in FIG. 23.

When the power of an input signal is relatively large in the high efficient power amplifier of this structure, the signal is amplified using both the power amplifiers (90) by making two switches (80) "on". When the power of an input signal is smaller than the reference power, the input signal is amplified by only one power amplifier (90, above) by making two switches (80) "off". Therefore, the power efficiency can be improved as shown in FIG. 24(*c*) compared when only one power amplifier is used. In FIG. 23, the left upper port is an input and the right upper port is an output. When the power of an input signal is smaller than the reference power in this embodiment of the present invention, only one power amplifier is used with the divide/through switches in through mode. When the power of an input signal is larger than the reference power, two power amplifiers are used with the divide/through switches in divide mode. Accordingly, we can realize a high efficient power amplifier regardless of the power of the input signal.

FIG. 24 shows the output power and PAE (Power Added Efficiency) of the high efficient power amplifier in FIG. 23. FIG. 24(*a*) displays the PAE curve of the class A power amplifier in the case where the DC of an amplifier (90, below) can be turned off in the through mode. In this case, the PAE in the off-state is higher than the on-state PAE at low input power. FIG. 24(*b*) shows the PAE curve of the class A power amplifier when there is no DC switching, and the PAE in off-state is smaller than the on-state PAE over the whole range of input power. FIG. 24(*c*) illustrates the PAE curve of the class AB power amplifier without DC switching. Although the DC is not switched, the off-state PAE is higher than the on-state PAE at low input power. Therefore, we can establish the intersection point of the two PAE curves as a switching point.

As discussed above, the present invention provides an improved microwave DPDT switch, a microwave divide/through switch, and a highly efficient power amplifier. The improved microwave DPDT switch, routing two input signals into two output signals, has a simpler structure than older DPDT switch. The microwave divide/through switch divides an input signal into two output signals or transmits the input signal to an output signal. Since the high efficient power amplifier uses divide/through switches instead of branch line couplers, the amplifier has a better power efficiency.

While the foregoing invention has been described in terms of the embodiments discussed above, numerous variations are possible. Accordingly, modifications and changes such as those suggested above, but not limited thereto, are considered to be within the scope of the following claims.

What is claimed is:

1. A highly efficient power amplifier comprising:

(a) two microwave divide/through switches, composed of:

(a1) a 90° branch line coupler having two gaps at the branch lines among two input ports and two output ports; and (a2) two SPST (Single-Pole Single-Throw) switches located at the two branch line gaps, for dividing or transmitting input signals to the output ports;

(b) two power amplifiers, connected with the two microwave divide/through switches, for amplifying the signal power transmitted from the first microwave divide/through switch; and (c) a half-wavelength transformer, connected ton an output terminal of one of the two power amplifiers, for delaying the phase of the amplified signal by a half-wavelength.

2. A highly efficient power amplifier us defined in claim 1, wherein:

(a) only one power amplifier amplifies the signal with the divide/through switches in through-mode when the power of an input signal is smaller than the reference power; and (b) two power amplifiers are used with the divide/through switches in divide-mode when the power of an input signal is larger than the reference power.

* * * * *

UNITED STATES PATENT AND TRADEMARK OFFICE

CERTIFICATE OF CORRECTION

PATENT NO. : 6,667,670 B2
APPLICATION NO. : 09/756757
DATED : December 23, 2003
INVENTOR(S) : Soung-Chol Hong et al.

It is certified that error appears in the above-identified patent and that said Letters Patent is hereby corrected as shown below:

Title page, item (30) - Foreign Application Priority Data should read as follows:
July 25, 2000 (KR).....2000-42613

Signed and Sealed this
Fourth Day of October, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 6,667,670 B2
APPLICATION NO. : 09/756757
DATED : December 23, 2003
INVENTOR(S) : Song-Chol Hong, Doo-Young Ha It is certified that error appears in the above-identified patent and that said Letters Patent is hereby corrected as shown below:

Cover page, item (30), delete "20000-42613" and replace with --10-2000-42613--.

Signed and Sealed this
Seventeenth Day of January, 2012

David J. Kappos

David J. Kappos
*Director of the United States Patent and Trademark Office*